United States Patent [19]

Herzan et al.

[11] 4,372,204

[45] Feb. 8, 1983

[54] LITHOGRAPHIC SHEET FED PRESS HAVING MEANS FOR CLEARING A JAMMING CONDITION

[75] Inventors: Georg Herzan, Bad Soden; Claus Simeth, Offenbach am Main; Herbert Rebel, Rodgau, all of Fed. Rep. of Germany

[73] Assignee: M.A.N.-ROLAND Druckmaschinen Aktiengesellschaft, Fed. Rep. of Germany

[21] Appl. No.: 202,625

[22] Filed: Oct. 31, 1980

[30] Foreign Application Priority Data

Nov. 2, 1979 [DE] Fed. Rep. of Germany ..... 2944272

[51] Int. Cl.[3] ..... B41F 13/28; B41F 13/40

[52] U.S. Cl. ..... 101/145; 101/140; 101/234; 101/247

[58] Field of Search ..... 101/218, 140, 182, 247, 101/137, 139, 143, 144, 145, 184, 185, 234

[56] References Cited

U.S. PATENT DOCUMENTS

| | | | |
|---|---|---|---|
| 1,301,970 | 4/1919 | Pritchard | 101/218 |
| 1,591,127 | 7/1926 | Harrold | 101/184 |
| 2,578,700 | 12/1951 | Harrold | 101/247 |
| 2,609,748 | 9/1952 | Brigham | 101/247 |
| 2,689,524 | 9/1954 | Wood | 101/247 |
| 2,773,445 | 12/1956 | Wood | 101/218 |
| 3,329,086 | 7/1967 | Pullen | 101/218 |

FOREIGN PATENT DOCUMENTS 2053094 2/1981 United Kingdom ..... 101/137

*Primary Examiner*—Clyde I. Coughenour

*Attorney, Agent, or Firm*—Leydig, Voit, Osann, Mayer & Holt, Ltd.

[57] ABSTRACT

A lithographic sheet fed press having means for clearing a jamming condition in which a plurality of sheets become wedged between the blanket and impression cylinders. The blanket cylinder is journaled in eccentric bushings having respective operating arms. Toggle linkages are respectively interposed between each arm and the associated frame plate and settable in a slightly overcenter operating condition for maintaining normal printing pressure between the blanket cylinder and the impression cylinder. A toggle-breaking power actuator is laterally coupled to the toggle linkages for breaking the same to the opposite side of dead center. A back-off power actuator is coupled to the bushings for imparting substantial rotation to the bushings accompanied by relief of pressure and full collapse of the toggle linkages with scissoring action. The actuators are energized in sequence to secure (a) release of the toggle linkages and (b) backing off of the blanket cylinder from the impression cylinder. The toggle linkages are re-set to their overcenter operating condition following removal of the wedged sheets. The toggle linkages are mirror images of one another and are preferably interconnected by cross shafting to keep the movements at each end of the blanket cylinder in step with one another.

9 Claims, 7 Drawing Figures

FIG. 3
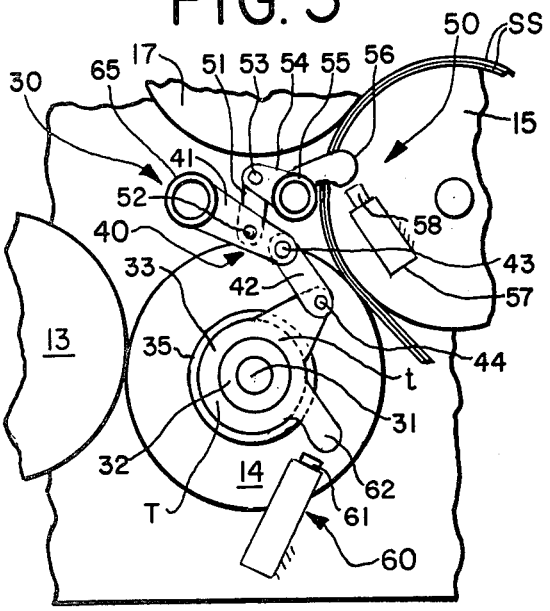
FIG. 5
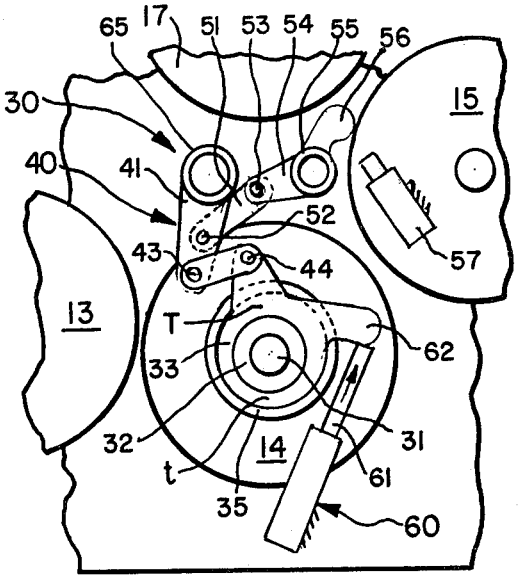
FIG. 4
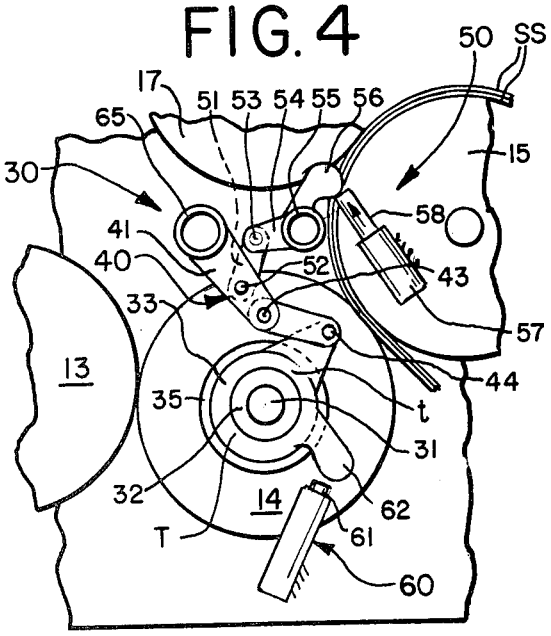
FIG. 6
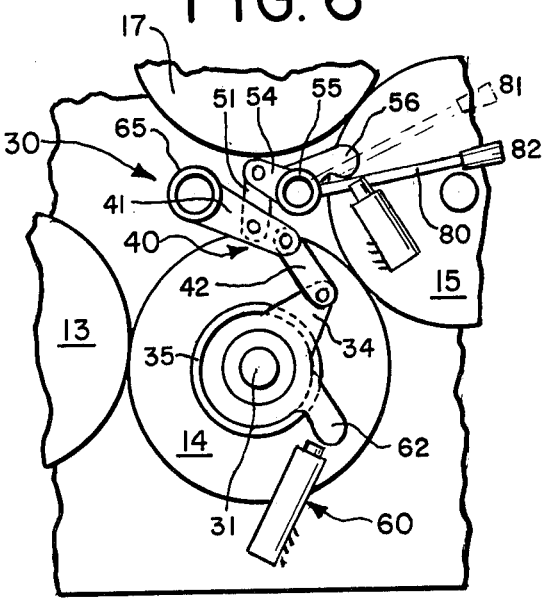
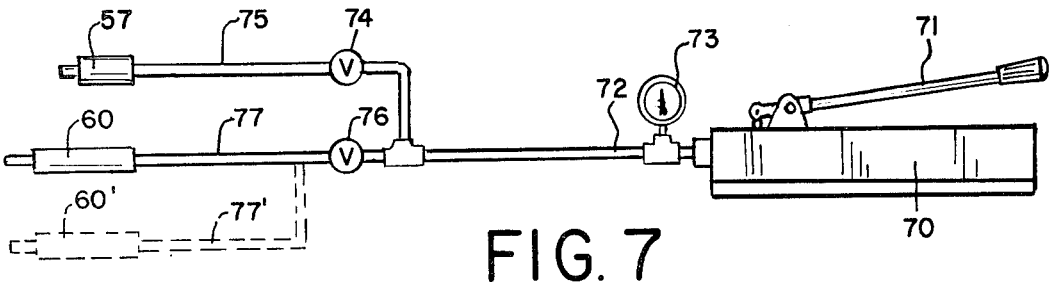
FIG. 7

LITHOGRAPHIC SHEET FED PRESS HAVING MEANS FOR CLEARING A JAMMING CONDITION

In a lithographic sheet-fed press sheets are fed one by one along a feed table and are picked up by a pre-gripper for transfer to the impression cylinder of the press unit. However, in spite of the inclusion of safety devices on the feed table it sometimes happens that several sheets may enter a printing unit at the same time. The additional thickness causes wedging of the sheets between the impression and blanket cylinders, the resulting overload tripping the press drive and stopping the press with the cylinders under great stress in a jamming condition. Even where sheets are fed from the table singly the sheet may, in the use of "short" or sticky printing inks, become stuck to the blanket cylinder, with the additional thickness of the subsequent sheet resulting in the same type of jamming and overload. While all presses have means for "throwing off" the impression, that is, separating the cylinders from one another, the high pressures which accompany the jamming condition make the usual type of manual throw-off inoperative. Nor can the cylinders be "inched" along by the driving motor to clear the jam because the excess load causes binding of the bearings by reason of the squeezing out of the lubricant film with resultant metal-to-metal contact. Thus the only solution to a serious jamming condition is to partially disassemble the press which, with subsequent re-assembly, is a serious matter because of the lost down time and the large element of labor cost.

It is, accordingly, the object of the present invention to provide a lithographic sheet fed press which permits a jamming condition caused by entry of multiple sheets to be cleared by operation of a few simple elements provided directly on the press unit reliably and routinely with only a few minutes of down time and without necessity for the services of a mechanic.

It is another object of the invention to provide means for clearing a jamming condition in a sheet-fed press which is so economical as to permit installation in all such presses as a matter of insurance against the possibility that a jam may occur.

It is still another object to provide means for reliably and safely overcoming the large cylinder-to-cylinder forces which accompany the jamming condition and which must be relieved before the jam can be cleared.

It is, more specifically, an object to provide means for releasing and collapsing the toggle linkages which are interposed between eccentric bushings and the frame plate and which have an overcenter operating condition for maintaining normal printing pressure between the blanket cylinder and the impression cylinder, even though such toggle linkages may become tightly locked and rigid as a result of the jamming condition. In this connection it is an object to provide separate hydraulic actuators for breaking the toggles and for rotating the eccentric bushings accompanied by full collapse of the toggle linkage with scissoring action.

It is yet another object of the invention to provide means for relieving the extreme pressures accompanying a jamming condition and for backing off the cylinders from one another, so that the offending sheets may be removed, which acts simultaneously and uniformly at both ends of the cylinder so that the cylinder does not become skewed with respect to the frame.

It is still another object of the invention to provide means for relieving a jamming condition in a sheet-fed press which is of universal usage, which may be readily incorporated in new designs of presses and which may be retrofitted, as well, in existing designs of presses, even presses already in the field, at minor cost.

Other objects and advantages of the invention will become apparent upon reading the attached detailed description and upon reference to the drawings in which:

FIG. 3 is a fragmentary enlarged view of a jam releasing mechanism associated with one of the blanket cylinders in FIG. 1 and illustrating the jamming condition caused by the interposition of multiple sheets.

FIG. 4 is a stop motion view showing the result of operating the short stroke toggle-breaking power actuator.

FIG. 5 is a stop motion view showing the effect of operating the long stroke back-off power actuator for extreme rotation of the bushing accompanied by full collapse of the toggle and with the offending sheets removed.

FIG. 6 is a stop motion view showing re-setting of the impression for resumption of normal press operation.

FIG. 7 shows the hydraulic circuitry for sequentially operating the actuators employing a hand pump and associated valving.

While the invention has been described in connection with certain preferred embodiments, it will be understood that the invention is not necessarily limited to the embodiments disclosed and that we intend to cover the various alternative and equivalent constructions included within the spirit and scope of the appended claims.

Figure 1:
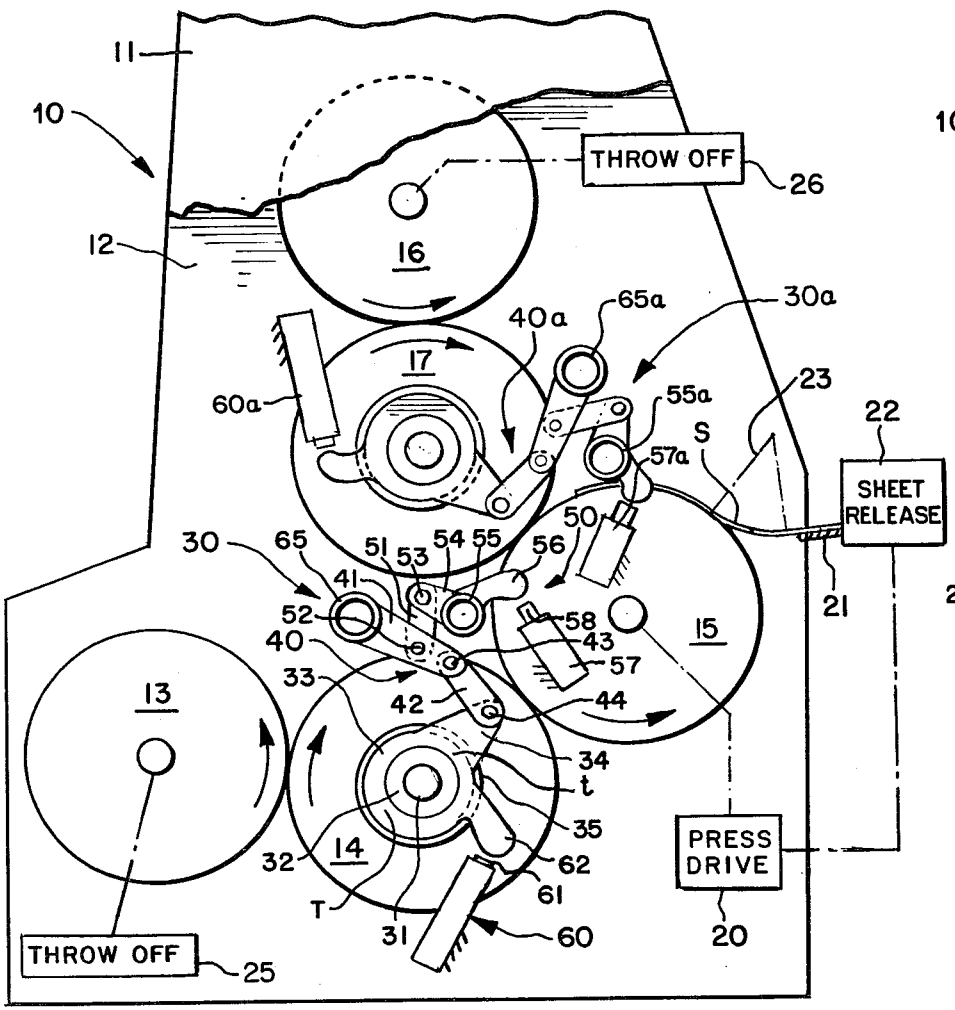
FIG. 1 is a simplified elevational view showing a sheet-fed lithographic press unit incorporating the present invention.

Turning now to FIG. 1 there is shown, in simplified end elevation, a press unit 10 having a frame in the form of end walls, or end plates, 11, 12 journalling the usual cluster of cylinders found in a lithographic printing unit. The cylinders include a first printing couple consisting of a plate cylinder 13, a blanket cylinder 14 and an impression cylinder 15. A second printing couple is formed by a plate cylinder 16, a blanket cylinder 17 and the same impression cylinder 15. The cylinders are all driven in unison by a press drive indicated diagrammatically at 20.

For feeding of sheets one by one to grippers (not shown) on the impression cylinder 15, as is conventional, a feed table 21 is provided having a sheet release mechanism 22 which is timingly coupled to the press drive. A sheet released from the feed table is picked up by a swinging pregripper 23, also synchronized with the press drive and which, being conventional, is also shown diagrammatically.

In operation, a sheet S fed from the feed table passes between the impression cylinder and blanket cylinder 17 where it receives a first impression, say in one color of ink, from which the sheet, following the impression cylinder, passes into printing engagement with the blanket cylinder 14 to receive a second printed impression prior to discharge.

It will be understood that plate cylinder throw-off devices, indicated at 25, 26 are provided for the plate cylinders 13, 16 and which are used to back off the plate cylinders when changing a plate or preparatory to the backing off of the associated blanket cylinders 14, 17 from their impression cylinder 15 as, for example, when clearing the jamming condition to be discussed.

For the purpose of establishing normal printing pressure between the blanket cylinder 14 and the cooperating impression cylinder, referring to as "establishing impression", a pressurizing and throw-off mechanism 30 is provided, such mechanism determining the lateral position of the cylinder 14 with respect to the cylinder 15. Such mechanism supports the stub shafts 31 of the cylinder 14. Each stub shaft is received in a bearing 32 which is telescoped into an eccentric bushing 33 having a thick side T and a thin side t and an integral operating arm 34. The outer surface of the bushing is snugly received in a sleeve 35 which is, in turn, supported in an opening formed in the end wall or end plate of the press.

For the purpose of holding, indeed temporarily locking, the eccentric bushing 33 in an operating position in which printing pressure is applied between the cylinders 14, 15, a toggle linkage 40 is provided made up of links 41, 42, the link 41 being pivoted to the press frame. The links are interconnected at a central pivot 43, and the link 42 is connected to the arm 34 by a pivot 44. The links are settable in a slightly overcenter operating condition illustrated in FIG. 1.

Figure 2:
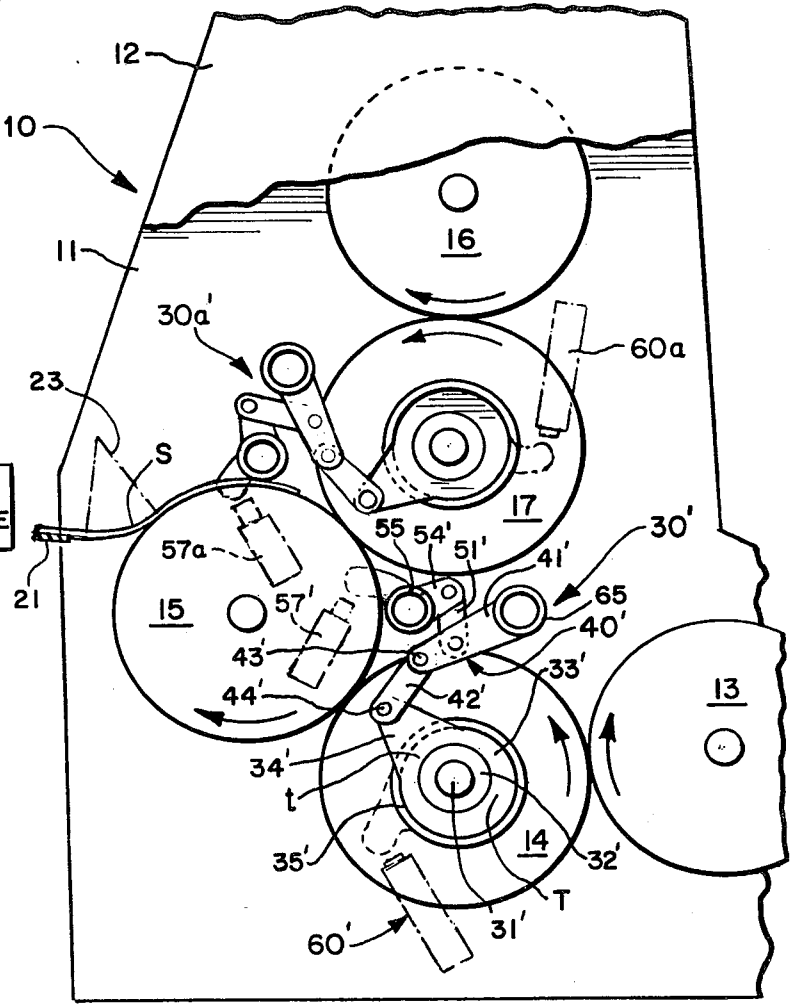
FIG. 2 is an elevational view similar to FIG. 1 but showing the opposite side of the press unit.

It will be understood that a similar arrangement of eccentric bushing and toggle linkage is provided at the opposite end of the blanket cylinder 14 as shown in FIG. 2 where similar reference numerals have been employed with the addition of a prime. It will further be understood that a similar pressurizing and throw-off mechanism is provided for the blanket cylinder 17, as indicated at 30*a*, but since such mechanism is identical to the mechanism 30 it need not be discussed and, to the extent required, corresponding reference numerals have been employed with addition of subscript a.

When the press is operating normally and with the toggles 40, 40*a* in their normal pressure-applying positions shown in FIGS. 1 and 2, the thickness of a single sheet of paper is readily accommodated between the cylinders. However, as stated, it sometimes happens, due to malfunction, that two or more sheets are fed from the table at the same time as indicated at S, S in FIG. 3. The additional thickness cannot be accommodated by the cylinders resulting not only in heavy transaxial loading, producing a jamming condition, but also an overloading of the press drive, with the current inrush tripping the breakers associated with the driving motor to bring the press into immediate halt. The extremely high pressure developed between the cylinders has several effects. One effect is to squeeze the lubricant out of the bearings to produce metal to metal contact so that the cylinders cannot be moved even by the jogging or inching of the press drive motor. Secondly, such high forces are developed in the toggle, which is normally positioned beyond dead center, that the toggle cannot be manually "broken", that is, thrown to the other side of dead center, to relieve the pressure.

In accordance with the present invention, therefore, a special pressure relieving means is provided including a toggle-breaking power actuator laterally coupled to the toggle linkages combined with a back-off power actuator coupled to the eccentric bushings for imparting substantial rotation to the bushings, with means for sequentially energizing the power actuators so that the toggle linkages are first broken and then fully collapsed for rotation of the bushings and separation of the cylinders enabling the offending sheets to be removed.

Thus we provide a special pressure relieving mechanism 50 which includes an auxiliary link 51 centrally pinned, at 52, to the first toggle link and having its other end pivoted, at 53, to an arm 54 on a shaft 55. Secured to the shaft 55 is an operating arm 56. Arranged opposite the operating arm, and secured to the press frame, is a toggle breaking power actuator 57 mounting a plunger, or piston, 58, the actuator having a short stroke just sufficient to accomplish its toggle-breaking function.

Further in accordance with the invention the bushing 33 is substantially rotated in the pressure relieving direction by a second, or back-off, power actuator 60 having a plunger, or piston, 61 providing a relatively long stroke, the plunger being coupled to the eccentric by means of an arm 62 which is integral with the eccentric and which is positioned in the path of movement of the plunger.

Thus to relieve a jamming condition the short stroke actuator 57 is energized rocking the shaft 55 counterclockwise and applying thrust to the auxiliary link 51 which forcibly breaks the toggle linkage 40 over center. This is immediately followed by energization of the long stroke actuator 60 which rotates the eccentric bushing 33 counterclockwise for full collapsing movement of the toggle linkage accompanied by relief of pressure and actual separation of the cylinders for clearing of the jam.

In accordance with the preferred form of the invention means are provided for accomplishing the breaking of the toggle and rotation of the eccentric bushing in unison with the above at the opposite end of the blanket cylinder 14. For this purpose the link 41 of the toggle is rigidly connected to a cross shaft 65 which is preferably of large diameter, hollow construction to provide a maximum stiffness-to-weight ratio, the cross shaft being similarly connected at its opposite end to the toggle link 41', in mirror image relation, at the opposite side of the press. Moreover, the shaft 55, which serves to break the toggle via the auxiliary link 51, is extended to the opposite side of the press for connection, in mirror image relation, to an arm 54' which acts upon an auxiliary link 51' so that the toggles on both sides of the press are broken overcenter simultaneously. The transmission of the motion from one side of the press to the other, by insuring that breaking of the toggles and rotation of the eccentric bushings will occur in unison, insures that the lateral motion will be at all times equalized at the ends of the blanket cylinder so that the blanket cylinder will never become skewed with respect to the frame in which it is mounted.

The effectiveness and convenience of the pressure relieving mechanism 50 will become apparent upon considering a typical operating cycle as set forth in steps in FIGS. 3–5 inclusive.

In FIG. 3, which illustrates the normal operating positions the toggle linkages and eccentric bushings, it will be assumed that a double thickness of sheet, indicated at S,S has entered the press unit and has produced a jamming condition resulting in automatic turn-off of the press driving motor and the creation of excessive pressure between the cylinders.

This unfortunate condition is immediately detected by the press operator who, after throwing off the plate cylinders, energizes the toggle breaking actuator 57. This, as shown in FIG. 4, causes counterclockwise rocking movement of the shaft 55 which, through the auxiliary links 51, 51' breaks both of the toggles 40, 40' overcenter. This can be done quickly and conveniently since the force which can be exerted by the pressure actuator greatly exceeds that which can be applied directly, by manual effort, to the system.

Promptly thereafter the operator energizes the second, or back-off, actuator 60 which serves to rotate the eccentric bushings 33 through a substantial angle in the clockwise direction, thereby imposing the thick portion T of the bushings between the axes of the cylinders 14, 15, relatively backing off the cylinder 14, to create a gap, indicated at G, between the cylinders. It will be understood that pressure is applied, in similar sequence, to the actuators 57*a*–60*a* in the upper stream to create a similar gap between the cylinders 17, 15, thereby permitting the offending sheets S,S, to be removed.

It is to be noted that while the toggle breaking power actuator 57 has only a short stroke and while the back-off actuator has a long stroke resulting in full collapse of the toggle linkage, a one-way force transmitting connection is employed at the end of the plunger 58 of the actuator 57 permitting the arm 56 to retreat from the plunger thereby to accommodate the full collapse of the linkage. A similar one-way force transmitting connection is preferably provided between the plunger 61 of the back-off actuator 60 and the bushing arm 62 which it engages.

The operation of the preferred form of the invention has been described above without reference to a source of pressure fluid. It is preferred that the actuators shall be of the hydraulic type with the pressure being obtained by use of a hand pump with valves interposed for connecting the pump sequentially to the actuators and for subsequently venting the actuators. Thus referring to FIG. 7 a simple low capacity hand pump 70 of the reciprocating type is provided having an operating arm 71 and an output connection 72 monitored by a pressure gauge 73. A valve 74 connects the output to the toggle-breaking actuator 57 via a line 75 while the second valve 76 may be opened in sequence to pressurize a line 77 leading to the back-off actuator 60. Where a companion actuator 60' is used on the other side of the press it may be fed from the same valve 76 via a supply line 77' shown dot-dash in FIG. 7.

The valving sequence will be apparent to one skilled in the art: First the valve 74 is opened permitting the pumping up of actuator 57 for breaking of the toggle. Next the valve 74 is closed and the valve 76 is opened permitting the pumping up of the back-off actuator 60 (and its companion 60', if used). The valves 74, 76 are preferably of the three-way type so that hydraulic fluid may be allowed to escape from the actuators after their function has been completed. To facilitate the escape of fluid and to restore the actuators to the contracted condition illustrated in FIG. 1, each of the actuators 57, 60 may be provided with a return spring (not shown).

After the offending sheets have been removed as described in connection with FIG. 5, the pressurizing and throw-off mechanism 30 and toggle 40, 40' thereof, may be restored to operating condition illustrated in FIG. 1. This may be accomplished by any desired means which effectively straightens the toggles and permits them to pass beyond dead center. Conveniently an operating handle 80 may be secured to the cross shaft 55. By throwing the operating arm clockwise from the position 81 to the position 82 in FIG. 6, tension is applied to the auxiliary links 51, 51' causing the toggle linkages 40, 40' to move from their collapsed condition through their straight condition to the illustrated, slightly-beyond-dead-center, position. This restores normal printing pressure between the blanket cylinder 14 and the impression cylinder 15 so that operation of the press may be resumed.

The operation has been discussed in connection with the single set of actuators 57, 60 which perform a pressure relieving function at both sides of the press in synchronism, through the agency of the cross shafts 55, 65. If desired, a separate set of actuators may be provided at the opposite sides of the press to supplement the action of the actuators 57, 60. Such supplementary actuators have been indicated at 57', 60' (FIG. 2) engaging operating arms 56, 62, respectively. Consequently, the term "actuator" as used herein shall be understood to mean either a single actuator, acting alone, or a pair of similar actuators equally pressurized and operating in concert with one another to perform their stated function.

If desired a single actuator may be used to perform one of the two functions while a dual actuator is used for the other. By way of example a single actuator 57 may be used acting through the cross shaft 55, to break both of the toggles 40, 40' at the respective sides of the press, while a dual actuator 60, 60' may be used to apply force simultaneously and directly against the eccentrics on both sides of the press without relying upon the cross shaft 65 which interconnects them.

It is of interest to note that where dual actuators (57, 57' and 60, 60') are used to perform both the toggle-breaking and back-off functions at the respective sides of the press, both of the cross shafts 55, 65 may, if desired, be dispensed with, provided that fluid is equally metered to both actuators comprising a pair. Devices for feeding hydraulic liquid from a single source to consuming devices at an equal and controllable rate of flow are well known in the art and commercially available and thus need not be discussed in detail. Suffice it to say that by use of such a device two identical hydraulic actuators remote from one another may be caused to undergo equal displacements, that is, act in step with one another.

While the invention in its preferred form provides means for applying pressurized fluid to the actuators 57, 60 in sequence, it is possible, without departing from the present invention, to connect both of the actuators to the same pressurized line while still obtaining the desired energization in sequence. The reason for this is that the two actuators 57, 60 are connected to the toggle linkages with unequal mechanical advantage, the actuator 57 acting laterally upon the toggle while the actuator 60 acts longitudinally, that is, endwise. Where pressure is applied to the two actuators by the same hydraulic line the substantially on-center condition of the toggles initially blocks movement of the actuator 60 whereas the actuator 57, acting laterally, is free to move in a direction to break the toggles over center. After the toggle has been broken the actuator 60 is then free to bring about full collapse of the toggle linkage accompanied by rotation of the eccentric bushings and backing movement of the blanket cylinder. Thus the term "means for sequentially energizing the power actuators" as used herein not only includes the use of valves for selective and individual application of pressure but includes the simple connection of the two actuators to a common pressurized line for inherent sequential action.

It will be clear that the objects of the invention have been abundantly realized. A jamming condition caused by feeding of multiple sheets may be promptly corrected simply by pressurizing two power actuators in sequence to break a rigidly pressurized toggle linkage to the other side of dead center followed by full collapsing movement of the toggle and separation of the cylinders from their jamming relation. No longer is it necessary to partially disassemble a press to correct a jamming condition with attendant down time and high labor cost. The procedure followed in the present invention is entirely safe and risk and wear and tear upon the press is minimized.

By the term "laterally coupled" used herein is meant means for applying force to a toggle linkage in a direction generally perpendicular to the direction of extension of such linkage for breaking of a toggle to the opposite side of dead center.

What we claim is:

1. A lithographic sheet fed press having means for clearing a jamming condition comprising, in combination, a pair of frame plates, a plate cylinder, blanket cylinder and an impression cylinder all having stub shafts journaled in the respective frame plates and arranged serially for rolling engagement of the cylinders with one another, means for feeding sheets to the impression cylinder, eccentric bushings interposed between the stub shafts of the blanket cylinder and the frame plates, the eccentric bushings having respective operating arms, toggle linkages respectively interposed between the arms and the associated frame plate and settable in a slightly overcenter operating condition for maintaining normal printing pressure between the blanket cylinder and the impression cylinder, means for relieving pressure between the blanket and impression cylinders upon the occurrence of a jamming condition in which a plurality of sheets become wedged between such cylinders, said pressure relieving means including (a) a toggle-breaking first power actuator laterally coupled to the toggle linkages for breaking the same to the opposite side of dead center, (b) a back-off second power actuator coupled to the bushings for imparting substantial rotation to the bushings accompanied by relief of pressure and full collapse of the toggle linkages with scissoring action, (c) means for sequentially energizing the first and second power actuators, and means for subsequently resetting the toggle linkages to the overcenter operating condition following removal of the wedged sheets.

2. A lithographic sheet fed press having means for clearing a jamming condition comprising, in combination, a pair of frame plates, a plate cylinder, blanket cylinder and an impression cylinder all having stub shafts journaled in the respective frame plates and arranged serially for rolling engagement of the cylinders with one another, means for feeding sheets to the impression cylinder, eccentric bushings interposed between the stub shafts of the blanket cylinder and the frame plates, the eccentric bushings each having an operating arm, toggle linkages respectively interposed between the operating arms and the associated frame plate and settable in a slightly overcenter operating condition for maintaining normal printing pressure between the blanket cylinder and the impression cylinder, the toggle linkages being mirror images of one another, means for relieving pressure between the blanket and impression cylinders upon the occurrence of a jamming condition in which a plurality of sheets become wedged between such cylinders, said pressure relieving means including (a) a toggle-breaking first power actuator laterally coupled to the toggle linkages for breaking the same to the opposite side of dead center, (b) a back-off second power actuator coupled to the bushings for imparting substantial rotation to the bushings accompanied by relief of pressure and full collapse of the toggle linkages with scissoring action, (c) a cross shaft journaled in the frame plates for swingably coupling together the toggle linkages for movement in unison, (d) means for sequentially energizing the first and second power actuators, and means for subsequently resetting the toggle linkages to the overcenter operating condition following removal of the wedged sheets.

3. A lithographic sheet fed press comprising, in combination, a pair of frame plates, a plate cylinder, blanket cylinder and an impression cylinder all having stub shafts journaled in the respective frame plates and arranged serially for rolling engagement of the cylinders with one another, means for feeding sheets to the impression cylinder, eccentric bushings interposed between the stub shafts of the blanket cylinder and the frame plates, the eccentric bushings having respective operating arms, toggle linkages interposed between the frame plates and the operating arms and settable in a slightly overcenter operating condition for maintaining normal printing pressure between the blanket cylinder and the impression cylinder, means for relieving pressure between the blanket and impression cylinders upon the occurrence of a jamming condition in which a plurality of sheets become wedged between such cylinders, said pressure relieving means including (a) a toggle-breaking first power actuator, (b) means including a first cross shaft journaled in the frame plates and laterally coupled to both of the toggle linkages and to the toggle-breaking power actuator for simultaneously breaking the same to the opposite side of dead center when the toggle-breaking power actuator is energized, (c) a back-off second power actuator, (d) means including a second cross shaft journaled in the frame plates and coupled to the eccentric bushings and to the back-off power actuator for simultaneously imparting substantial rotation to the bushings when the back-off power actuator is energized for backing off of the blanket cylinder accompanied by relief of pressure and full collapse of the toggle linkages with scissoring action, (e) means for sequentially energizing the toggle-breaking and back-off actuators, and means for subsequently resetting the toggle linkages to the overcenter operating condition following removal of the wedged sheets.

4. The combination as claimed in claim 1 or in claim 2 or in claim 3 in which the actuators are hydraulic and in which the means for sequentially energizing the actuators is in the form of a pump having means for connecting the pump sequentially to the actuators and for subsequently venting the actuators.

5. The combination as claimed in claim 1 or in claim 2 or in claim 3 in which the actuators are hydraulic and in which the means for energizing the actuators is in the form of a hand operated pump having valves for connecting the pump sequentially to the actuators and for subsequently venting the actuators.

6. The combination as claimed in claim 1 or in claim 2 or in claim 3 in which the toggle-breaking power actuator has a relatively short stroke and the back-off power actuator has a relatively long stroke, at least the toggle-breaking actuator having a one-way force-transmitting output connection to accommodate the collapsing movement of the toggles.

7. The combination as claimed in claim 2 in which the toggle linkages are in mirror image relation and in which the cross shaft is rigidly connected at its ends to one of the links of the respective toggle linkages.

8. The combination as claimed in claim 1 or in claim 2 or in claim 3 in which the toggle linkages are in mirror image relation.

9. The combination as claimed in claim 3 in which the toggle linkages are in mirror image relation and in which the second cross shaft is rigidly connected at its ends to one of the links of the respective toggle linkages.

* * * * *